US005703778A

United States Patent [19]

Takahashi et al.

[11] Patent Number: 5,703,778

[45] Date of Patent: Dec. 30, 1997

[54] TRAFFIC CONTROL METHOD FOR RELIEVING VEHICLE CONGESTION ON PARALLEL ROADS

[75] Inventors: Kazunori Takahashi, Hitachi; Nobuhiro Hamada, Hitachiota; Masao Takatoo, Hitachinaka; Tohru Nagai, Ibaraki-ken; Toshiko Suzuki, Hitachinaka; Souichi Furukawa, Kawasaki, all of Japan

[73] Assignee: Hitachi, Ltd., Tokyo, Japan

[21] Appl. No.: 457,500

[22] Filed: Jun. 1, 1995

Related U.S. Application Data

[63] Continuation-in-part of Ser. No. 913,902, Jul. 16, 1992.

[30] Foreign Application Priority Data

Jul. 19, 1991 [JP] Japan ..... 3-179539

[51] Int. Cl.[6] ..... G08G 1/065; G08G 1/07

[52] U.S. Cl. ..... 364/437; 364/436; 340/910; 340/913

[58] Field of Search ..... 364/436, 437, 364/438; 340/909, 910, 911, 913

[56] References Cited

U.S. PATENT DOCUMENTS

Re. 31,044 9/1982 McReynolds et al. ..... 364/437
3,825,890 7/1974 Miyazato et al. ..... 340/40
5,357,436 10/1994 Chiu ..... 364/436
5,477,217 12/1995 Bergan ..... 340/933

OTHER PUBLICATIONS

Congestion Assessment in London; C. G. Toomey; May 5, 1989; pp. 248–249; Traffic Engineering and Control, vol. 30, No. 5.

Optimum Assignment of a Reversible Lane in an Oversaturated Two–Way Traffic Link; D. Giazis; 1967; Vehicle Traffic Science; pp. 181–190.

Control System For Three Lane Tidal Flow Bridges; J. E. Longfoot; Date Unknown.

*Primary Examiner*—Michael Zanelli

*Attorney, Agent, or Firm*—Antonelli, Terry, Stout & Kraus, LLP

[57] ABSTRACT

A road traffic control method is provided which can continue to maximize the number of vehicles allowed to run on a road and shorten time required for a vehicle to reach a destination, by preventing and relieving congestion. The method controls traffic of vehicles running on each of a plurality of parallel running roads. Each road is made connected at an interval of a predetermined distance, and at least one of the plurality of roads has a plurality of lanes. The method includes the steps of: detecting traffic of vehicles running in two counter directions on each road, at a position before at least one connected point of each of the plurality of roads; and changing ratio between the numbers of lanes of at least one of the plurality of roads, in accordance with the detected traffic of vehicles running in the two counter directions.

36 Claims, 7 Drawing Sheets

| CONDITIONS | | OFFSET PRIORITY DIRECTION | |
|---|---|---|---|
| ROAD R1 | ROAD R2 | ROAD R1 | ROAD R2 |
| Q1 > Q2 | Q3 > Q4 | RIGHT DIRECTION | RIGHT DIRECTION |
| Q1 > Q2 | Q3 < Q4 | RIGHT DIRECTION | LEFT DIRECTION |
| Q1 < Q2 | Q3 < Q4 | LEFT DIRECTION | LEFT DIRECTION |
| Q1 < Q2 | Q3 > Q4 | LEFT DIRECTION | RIGHT DIRECTION |

FIG. 4

| CONDITIONS | | OFFSET PRIORITY DIRECTION | |
|---|---|---|---|
| ROAD R1 | ROAD R2 | ROAD R1 | ROAD R2 |
| $Q1 - Q2 > \alpha$ | $Q3 - Q4 > \beta$ | RIGHT DIRECTION | RIGHT DIRECTION |
| $Q1 - Q2 > \alpha$ | $Q4 - Q3 > \beta$ | RIGHT DIRECTION | LEFT DIRECTION |
| $Q1 - Q2 > \alpha$ | $-\beta < Q3 - Q4 < \beta$ | RIGHT DIRECTION | NOT SPECIFICALLY DETERMINED |
| $Q2 - Q1 > \alpha$ | $Q3 - Q4 > \beta$ | LEFT DIRECTION | RIGHT DIRECTION |
| $Q2 - Q1 > \alpha$ | $Q4 - Q3 > \beta$ | LEFT DIRECTION | LEFT DIRECTION |
| $Q2 - Q1 > \alpha$ | $-\beta < Q3 - Q4 < \beta$ | LEFT DIRECTION | NOT SPECIFICALLY DETERMINED |
| $-\alpha < Q1 - Q2 < \alpha$ | $Q3 - Q4 > \beta$ | NOT SPECIFICALLY DETERMINED | RIGHT DIRECTION |
| $-\alpha < Q1 - Q2 < \alpha$ | $Q4 - Q3 > \beta$ | NOT SPECIFICALLY DETERMINED | LEFT DIRECTION |
| $-\alpha < Q1 - Q2 < \alpha$ | $-\beta < Q3 - Q4 < \beta$ | NOT SPECIFICALLY DETERMINED | NOT SPECIFICALLY DETERMINED |

NUMBER OF LANES WITH DIRECTION CHANGED BY PATTERN CHANGE

| | | | | | |
|---|---|---|---|---|---|
| B | 0 | | | | |
| C | 2 | 2 | | | |
| D | 1 | 1 | 1 | | |
| E | 1 | 1 | 1 | 0 | |
| F | 1 | 1 | 3 | 2 | 2 |
| | A | B | C | D | E |

| | | |
|---|---|---|
| LANE ASSIGNMENT | R1 | R2 |
| TRAFFIC RATIO | 48:10 | |
| TRAFFIC CAPACITY INCREASE | 16% | |
| NOTE | RATHER INCONVENIENT FOR DRIVERS IN AREA NEAR ROAD R1 | |

| | | |
|---|---|---|
| TRAFFIC RATIO | 46:12 | |
| TRAFFIC CAPACITY INCREASE | 16% | |
| NOTE | RATHER INCONVENIENT FOR DRIVERS IN AREA NEAR ROAD R1 | |

| | | |
|---|---|---|
| TRAFFIC RATIO | 48:10 | |
| TRAFFIC CAPACITY INCREASE | 16% | |
| NOTE | RATHER INCONVENIENT FOR DRIVERS IN AREA NEAR ROAD R2 | |

LANE ASSIGNMENT
R1
R2
TRAFFIC RATIO
36:20
34:22
36:24
30:20
TRAFFIC CAPACITY INCREASE
12%
12%
20%
REFERENCE (0%)
NOTE
RATHER INCONVENIENT FOR DRIVERS IN AREA NEAR ROADS R1, R2

TRAFFIC CONTROL METHOD FOR RELIEVING VEHICLE CONGESTION ON PARALLEL ROADS

This is a continuation-in-part of application Ser. No. 07/913,902 filed Jul. 16, 1992, the subject matter of which is incorporated herein by reference.

BACKGROUND OF THE INVENTION

1. Field of the Invention

The present invention relates to a traffic control method for controlling traffic of vehicles on roads.

2. Description of the Related Arts

As described for example, in "Traffic Lights Control Technique" at pages 62–68 compiled by the corporate Traffic Engineering Study Group or "Practical Traffic Engineering Series 8, Management and Operation of Traffic on Roads" at pp. 125 to 135, operation parameters of traffic lights have been controlled heretofore so as to maximize the traffic of motor vehicles passing through each main intersection or through a set of main intersections, by using the results of traffic survey or traffic information measured by vehicle detectors.

A system for controlling the number of lanes of a two-lane road is disclosed in JP-A-49-129499. According to this system, if the traffic in one direction becomes heavy and the traffic in the other direction is very light, the two lanes are used for one-way traffic and vehicles running in the other direction are not allowed to enter the road.

Another system for controlling the number of lanes of a three-or-more-lane express highway without traffic lights control is disclosed in JP-A-3-289000. According to this system, a center line of a road is changed in accordance with the traffic to thereby change the numbers of lanes in one direction and in the other direction.

These conventional systems for controlling the number of lanes are, however, not satisfactory with regards to the following points. If two lanes of a two-lane road are used for one-way traffic, vehicles running in the other direction are not allowed to enter the road. If the traffic in both directions is heavy, this system cannot relieve congestion. The system for controlling the number of lanes of a three-or-more-lane road in accordance with the traffic does not consider the influence on traffic of stops at a red traffic light, and is insufficient for relieving congestion. If there is only one road, effective traffic control cannot be expected unless it has a plurality of lanes.

SUMMARY OF THE INVENTION

It is an object of the present invention to provide a road traffic control method capable of maximizing the number of vehicles allowed to run on a road and shortening a time required for a vehicle to reach a destination, by preventing and relieving congestion.

In order to achieve the above object of the invention, there is provided a method of controlling traffic of vehicles running on each of a plurality of parallel running roads, each road being connected at an interval of a predetermined distance, and at least one of the plurality of roads having a plurality of lanes, the method including the steps of: detecting traffic flow of vehicles running in two counter directions on each road, at a position before at least one branch point or connected point of each of the plurality of roads; and changing the ratio between the numbers of lanes of at least one of the plurality of roads, in accordance with the detected traffic of vehicles running in the two counter directions.

According to another aspect of the present invention, there is provided a method of controlling traffic of vehicles running on each of a plurality of parallel running roads, each road being connected at an interval of a predetermined distance, and a plurality of intersections with traffic lights being installed at each road at an interval of the predetermined distance, the method including the steps of: detecting traffic flow of vehicles running in two counter directions on each road, at a position before at least one branch point or connected point of each of the plurality of roads; and controlling an offset parameter of a plurality of traffic lights on each road, in accordance with the detected traffic flow of vehicles running in the two counter directions.

According to the invention, the ratio of the number of lanes in one direction to the number of lanes in the other direction is changed in accordance with the traffic flow of vehicles running on each of a plurality of parallel running roads, and the number of lanes corresponding to the traffic flow in each direction is assigned to each of the plurality of roads. It is therefore possible to increase the traffic capacity of the plurality of roads and to control the traffic flow in a broad area.

According to the invention, the offset parameter of each traffic light of each road is controlled in accordance with the traffic of vehicles running on each of a plurality of parallel running roads. Accordingly, the number of stops at red traffic lights of vehicles running in the direction with heavier traffic can be reduced, and the flow of vehicles on each road can be made smooth.

BRIEF DESCRIPTION OF THE DRAWINGS

FIG. 4 is a table showing another example of offset control used for explaining the invention.

DETAILED DESCRIPTION OF THE PREFERRED EMBODIMENTS

A first embodiment of the invention will be described with reference to the accompanying drawing.

Figure 1:
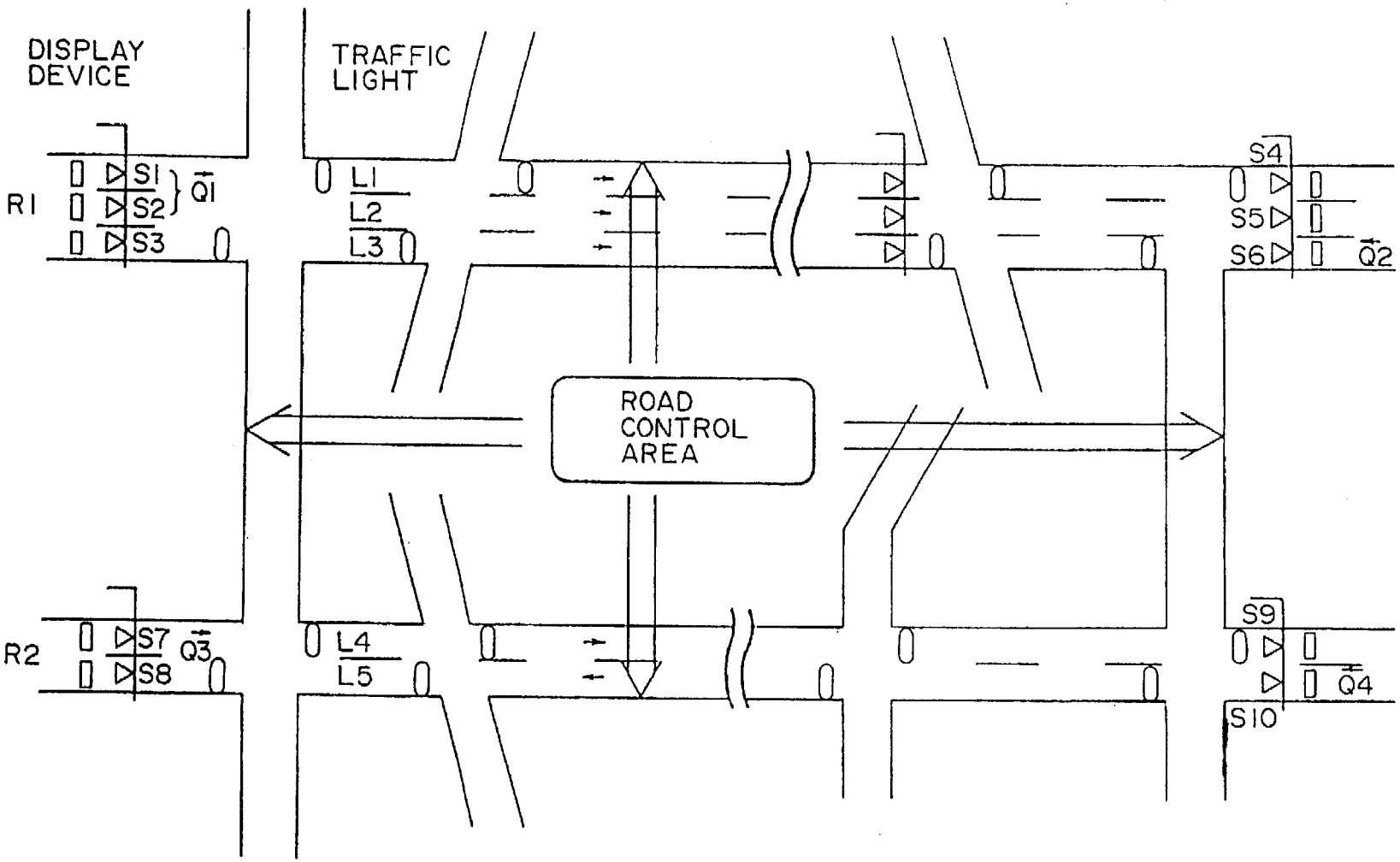
FIG. 1 is a schematic diagram of roads used for explaining the invention.

FIG. 1, roads R1 and R2 are parallel running roads, and each road is connected at an interval of a predetermined distance. The road R1 has three lanes, and the road R2 has two lanes. Lanes L1 and L2 of the road R1 are used for vehicles running to the right, and a lane L3 is used for vehicles running to the left. A lane L4 of the road R2 is used for vehicles running to the right, and lane L5 is used for vehicles running to the left. Vehicle detectors S1 and S10 are installed on the roads R1 and R2 to detect the traffic of vehicles on each lane within a road control area.

Traffic Q1 of vehicles moving to the road control area are detected by the vehicle detectors S1 and S2. A vehicle detector S6 detects traffic Q2, a vehicle detector S7 detects traffic Q3, and a vehicle detector S10 detects traffic Q4. A ratio of the traffic to the right to the traffic to the left in the road control area is calculated from the detected values of traffic Q1 and Q4 to determine the number of assigned lanes in each direction.

Figures 2, 3:
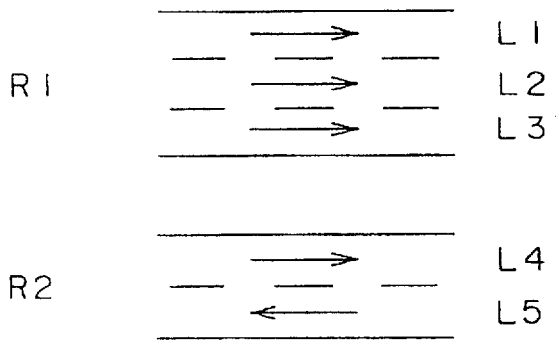
FIG. 2 a schematic diagram of two roads illustrating traffic of vehicles on lanes according to the invention.
FIG. 3 is a table showing an example of offset control used for explaining the invention.

For example, if a ratio of the traffic Q1+Q3 to the right to the traffic Q2+Q4 to the left is 4:1 and the traffic Q4 is larger than the traffic Q2, the number of lanes assigned is determined as shown in FIG. 2. Specifically, the lanes L1, L2 and L3 of the road R1 are used for vehicles running to the right. The lane L4 of the road R2 is used for vehicles running to the right, and the lane L5 of the road R2 is used for vehicles running to the left, to assign one lane for vehicles running to the right and left, respectively. In this manner, a ratio of the number of lanes to the right to the number of lanes to the left is changed.

In changing a lane (in this example, lane L3), after all vehicles on the lane get out of the road control area, the position of the center line is automatically changed. In this case, information of whether each lane is allowed to enter is displayed on a display device installed before each intersection.

Next, a second embodiment of the invention will be described.

If one road has a plurality of intersections, an offset quantity of each traffic light is controlled so as to give one of two counter directions a priority over the other and allow vehicles to run preferentially to the one direction. A lane allowing vehicles to move in the priority direction can deal with more traffic. According to the invention, a priority direction is dynamically assigned in accordance with a ratio of the traffic in one direction to the traffic in the other direction, respectively of vehicles on a plurality of roads each having a plurality of intersections.

More specific embodiments will be described with reference to FIGS. 3 and 4.

The traffic Q1 is compared with the traffic Q2 for the road R1, and the traffic Q3 is compared with the traffic Q4 for the road R2, to thereby determine an offset priority direction of the roads R1 and R2.

For example, as shown in FIG. 3, if Q1>Q2 and Q3>Q4, the offset priority direction of the roads R1 and R2 is towards the right. IF Q1>Q2 and Q3<Q4, the offset priority direction of the road R1 is towards the right and that of the road R2 is to the left. In this manner, the traffic in one direction is compared with the traffic in the other direction for each road, the offset priority direction is determined to be the direction having more traffic, and the traffic lights of each road are controlled.

In another example as shown in FIG. 4, values $\alpha$ and $\beta>0$ are predetermined. If $Q1-Q2>\alpha$ and $Q3-Q4>\beta$, the offset priority direction of the roads R1 and R2 is the right direction. If $Q1-Q2>\alpha$ and $Q4-Q3>\beta$, the offset priority direction of the road R1 is to the right and that of the road R2 is to the left. If $Q1-Q2>\alpha$ and $-\beta<Q3-Q4>\beta$, the offset priority direction of the road R1 is to the right and that of the road R2 is not specifically determined. In this manner, the traffic in one direction is compared with the traffic in the other direction for each road, the offset priority direction is determined to be the direction having more traffic than the predetermined value, and the offset priority direction is not specifically determined if traffic difference is equal to, or smaller than, the predetermined value.

Controlling an offset quantity will be described with reference to FIG. 5.

Figures 5, 8:
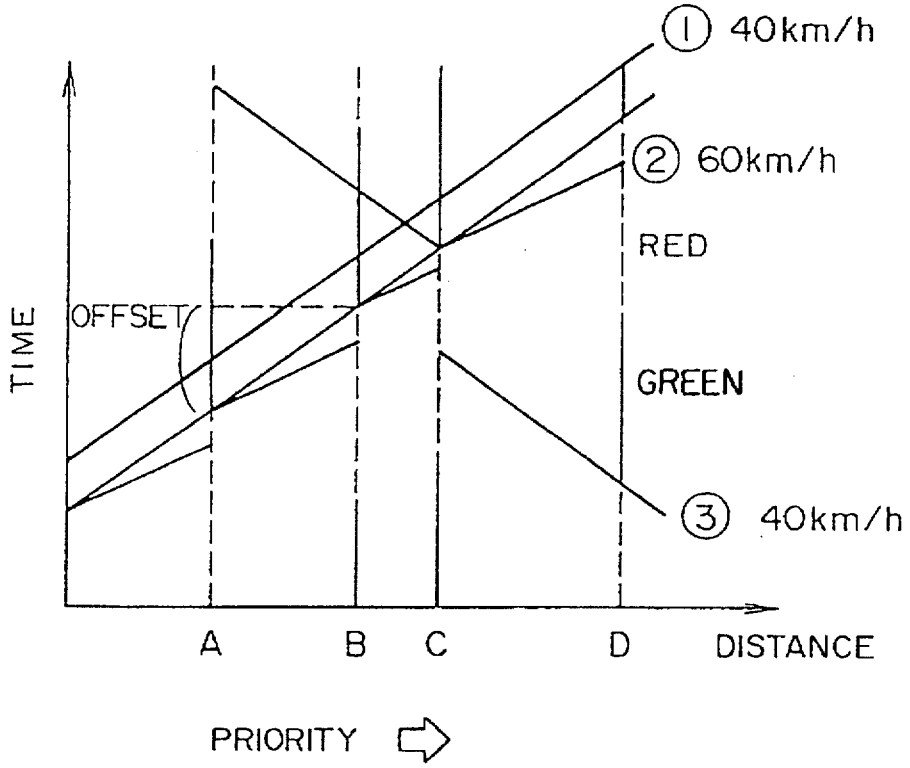
FIG. 5 is a graph illustrating offset patterns of traffic lights.
FIG. 8 is a diagram showing the number of lanes which changes the vehicle running direction when a pattern is changed, the diagram being used for explaining the invention.

FIG. 5 is a graph called an offset diagram showing traffic light patterns relative to distance and time. The abscissa represents distance (intersection), and the ordinate represents time. A to D represent intersections having traffic lights. A vertical line at each intersection represents a corresponding traffic light pattern, whereby broken line indicates a red traffic light, and a solid line indicates a green traffic light. An oblique line (vehicle running line) indicates a locus of a running vehicle. The offset parameter of the traffic light at each intersection is controlled assuming that the priority direction is a direction from the intersection A toward the intersection D. An offset parameter is defined to be a difference between green traffic light turn-on start times at adjacent intersections such as the intersections A and B. The offset parameter is controlled so that, as indicated by a vehicle running line (1), if a vehicle runs in the priority direction at a predetermined speed (40 km/h), it can pass through each intersection without stopping. A vehicle running in the priority direction hardly stops at any red traffic light, and therefore more traffic can be permitted. In contrast with this, if a vehicle runs at a speed (60 km/h) greater than a predetermined speed as indicatedby a vehicle running line (2) or runs in the direction opposite to the priority direction as indicated by a vehicle running line (3), it often stops at a red traffic light.

Next, a method of controlling the traffic of vehicles on roads will be described by combining the above-described traffic control schemata. Specifically, a plurality of roads are parallel running roads, and each road is made continuous at an interval of a predetermined distance. A plurality of intersections with traffic lights are installed at each road at an interval of the predetermined distance. At least one of the plurality of roads has a plurality of lanes.

First, changing the number of assigned lanes will be described. As shown in FIG. 1, the roads R1 and R2 are parallel running roads, the road R1 has three lanes (lanes L1, L2, and L3), and the road R2 has two lanes (lanes L4 and L5). In this case, six traffic control methods are possible when considering the vehicle running direction of each lane and the priority direction of each road (actually twelve methods are possible when considering a reversed traffic ratio). The six traffic control methods will be described with reference to FIGS. 6A–6G.

Figure 6A:
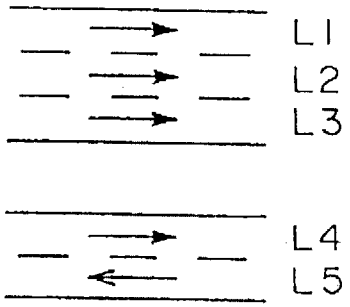
FIGS. 6A to 6G show two roads illustrating traffic of vehicles on lanes when priority offset control is performed according to the invention.

Traffic Control A (FIG. 6A)

The three lanes of the road R1 are all used for vehicles running to the right. For the road R2, lane L4 is used for vehicles running to the right and lane L5 is used for vehicles running to the left. The road R1 has the right as its offset priority direction, and the road R2 also has the right as its offset priority direction, to accordingly control the offset quantity of each traffic light of each road. A bold arrow indicates the priority direction based on which an offset quantity is controlled.

Figure 6B:
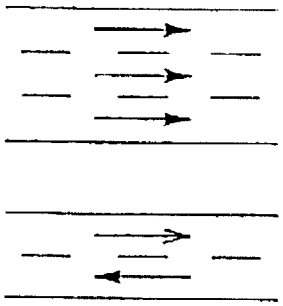

Traffic Control B (FIG. 6B)

The three lanes of the road R1 are all used for vehicles running to the right. For the road R2, the lane L4 is used for vehicles running to the right and the lane L5 is used for vehicles running to the left. The road R1 has the right as its offset priority direction, and road R2 has the left as its offset priority direction, to accordingly control the offset quantity of each traffic light of each road.

Figure 6C:
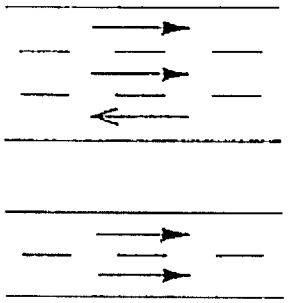

Traffic Control C (FIG. 6C)

For the road R1, lanes L1 and L2 are used for vehicles running to the right and lane L3 is used for vehicles running to the left. For the road R2, all the lanes are used for vehicles running to the right. The road R1 has the right as its offset priority direction, and the road R2 also has the right direction as its offset priority, to accordingly control the offset quantity of each traffic light of each road.

Figures 6D, 6E, 6F, 6G:
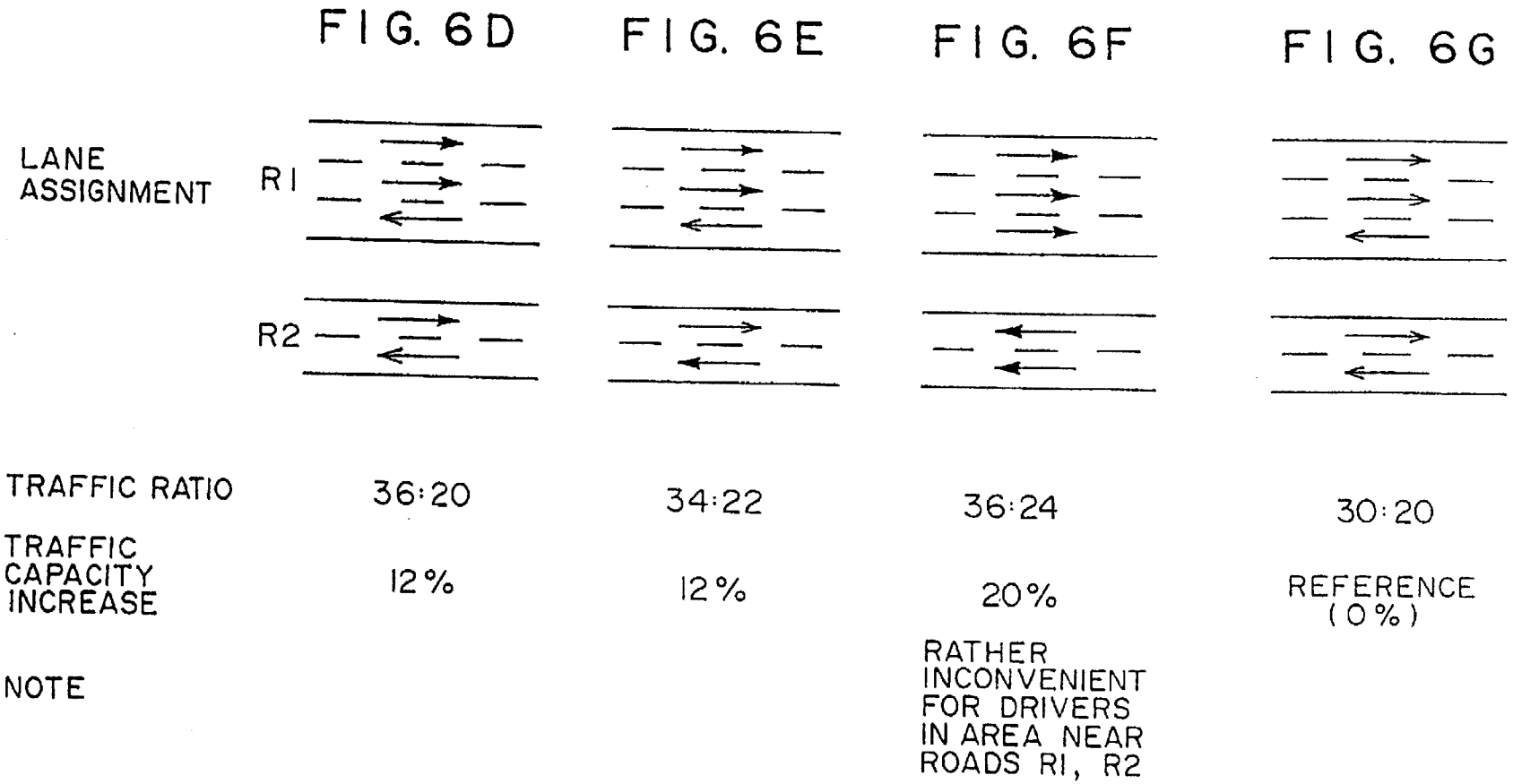

Traffic Control D (FIG. 6D)

For road R1, lanes L1 and L2 are used for vehicles running to the right and lane L3 is used for vehicles running to the left. For the road R2, the lane L4 is used for vehicles running to the right and the lane L5 is used for vehicles running to the left. The road R1 has the right as its offset priority direction, and the road R2 also has the right as its offset priority direction, to accordingly control the offset quantity of each traffic light of each road.

Traffic Control E (FIG. 6E)

For road R1, lanes L1 and L2 are used for vehicles running to the right and lane L3 is used for vehicles running to the left. For road R2, lane L4 is used for vehicles running to the right and lane L5 is used for vehicles running to the left. The road R1 has the right as its offset priority direction, and the road R2 has the left as its offset priority direction, to accordingly control the offset quantity of each traffic light of each road.

Traffic Control F (FIG. 6F)

The three lanes of the road R1 are all used for vehicles running to the right, and the two lanes of the road R2 are all used for vehicles running to the left. The road R1 has the right as its offset priority direction, and the road R2 has the left as its offset priority direction, to accordingly control the offset quantity of each traffic light of each road.

Traffic Control G (FIG. 6G)

This traffic control does not incorporate the traffic control of this invention. For road R1, lanes L1 and L2 are used for vehicles running to the right and lane L3 is used for vehicles running to the left. For the road R2, lane L4 is used for vehicles running to the right and lane L5 is used for vehicles running to the left. The offset priority direction of roads R1 and R2 are not specifically determined, and the offset quantity of each traffic light of each road is controlled.

It is assumed that the traffic capacity in the priority direction increases by 20% if the offset quantity of each traffic light is controlled by setting one direction as the priority direction, as compared to not controlling the offset quantity that is controlled by setting one direction as the priority direction. In other words, it is assumed that the traffic capacity in the priority direction increases from 10 to 12 vehicles if the offset quantity is controlled by setting one direction as the priority direction. In the traffic control G, the offset quantity is not controlled by setting one direction as the priority direction. Therefore, assuming that each of the three lanes of the road R1 and each of the two lanes of the road R2 have a traffic capacity of 10, the traffic capacity to the right is 30 and that to the left is 20.

With the above assumption, for the traffic control A, the traffic capacity of each of the lanes L1, L2, L3 and L4 is 12, and that of the lane L5 is 10. Therefore, the traffic capacity to the right is 12×4=48, and that to the left is 10. The total traffic capacity of the roads R1 and R2 is therefore 58, being increased by 16% as compared to the traffic control G.

For the traffic control B, the traffic capacity of each of the lanes L1, L2, L3, and L5 is 12, and that of the lane L4 is 10. Therefore, the traffic capacity to the right is 46, and that to the left is 12. The total traffic capacity of the roads R1 and R2 is therefore 58, being increased by 16% as compared to the traffic control G.

For the traffic control C, the traffic capacity of each of the lanes L1, L2, L4, and L5 is 12, and that of the lane L3 is 10. Therefore, the traffic capacity to the right is 48, and that to the left is 10. The total traffic capacity of the roads R1 and R2 is therefore 58, being increased by 16% as compared to the traffic control G.

For the traffic control D, the traffic capacity of each of the lanes L1, L2, and L4 is 12, and that of each of the lanes L3 and L5 is 10. Therefore, the traffic capacity to the right is 36, and that to the left is 20. The total traffic capacity of the roads R1 and R2 is therefore 56, being increased by 12% as compared to the traffic control G.

For the traffic control E, the traffic capacity of each of the lanes L3 and L4 is 10. Therefore, the traffic capacity to the right is 36, and that to the left is 20. The total traffic capacity of the roads R1 and R2 is therefore 56, being increased by 12% as compared to the traffic control G.

For the traffic control F, the traffic capacity of each of the lanes L1, L2, L3, L4, and L5 is 12. Therefore, the traffic capacity to the right is 36, and that to the left is 24. The total traffic capacity of the roads R1 and R2 is therefore 60, being increased by 20% as compared to the traffic control G.

Next, a method of selecting traffic control pattern will be described with reference to FIG. 7.

Figure 7:
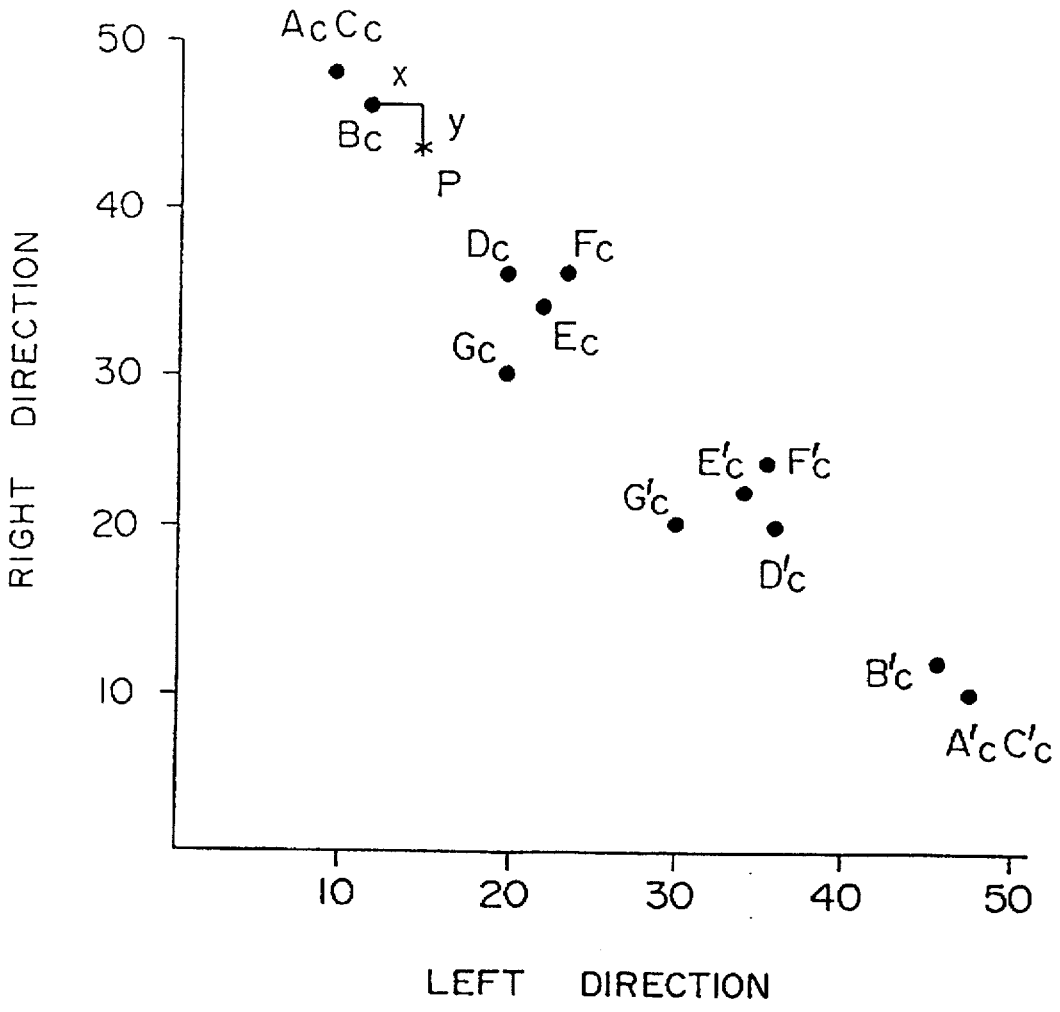
FIG. 7 is a graph used for explaining an optimum pattern selecting method according to the invention.

In FIG. 7, the abscissa represents traffic (traffic capacity) to the left on roads R1 and R2, and the ordinate represents traffic (traffic capacity) to the right on roads R1 and R2. The traffic capacity to both the right and left obtained by the traffic control A is indicated by $A_c$ in FIG. 7. Similarly, the traffic capacities to the right and left obtained by the traffic controls B to F are indicated by $B_c$ to $F_c$ in FIG. 7, respectively. The traffic capacities to the right and left obtained by traffic controls A' to F' are indicated by $A'_c$ to $F'_c$ have vehicle running directions of lanes opposite to the traffic controls A to F.

For example, the current traffic of vehicles on the roads R1 and R2 is assumed that the traffic in the right direction is 44 and that in the left direction is 15. This point P is indicated in FIG. 7.

A difference between the point P and the traffic to the left by each of the traffic controls A to F is represented by x, and a difference between the point P and the traffic in the right direction is represented by y. Differences between the points $A_c$ and P are x=5 and y=4, and x+y=9. Differences between the points $B_c$ and P are x=3 and y=2, and x+y=5. Differences between the points $D_c$ and P are x=5 and y=8, and x+y=13. In this manner, a sum (x+Y) of traffic differences x and y in the right and left directions by each of the traffic controls A to F and the current traffic is calculated. A traffic control pattern is selected which has a minimum value of (x+Y) as a difference from the point P. It is therefore possible to select a traffic control pattern suitable for a current traffic (in this case, the traffic control B is selected) and to perform optimum traffic control.

The number of lanes which change the vehicle running direction when the traffic control of the roads R1 and R2 is changed, is shown in the diagram of FIG. 8. For example, the number of lanes which change the vehicle running direction when the traffic control A is changed to the traffic control D, is 1. The number of lanes which change the vehicle running direction when the traffic control B is changed to the traffic control C, is 2. If the number of lanes which change the vehicle running direction is as large as 3, such as a change of the traffic control C to the traffic control F, such a change is not very desirable. In changing the traffic control, it is preferable to select a traffic control pattern which least affects the current traffic and is most effective, by taking into consideration the current traffic and the number of lanes which change the vehicle running direction. It is also preferable to select a traffic control pattern, by taking into consideration the demands of drivers in an area near the roads.

According to the invention, the number of lanes of a plurality of parallel running roads is assigned in accordance with the current traffic capacity. It is therefore possible to increase the traffic capacity of the plurality of roads, to control the traffic in a broad area, and to reliably prevent and relieve congestion.

According to the invention, the offset parameter of each traffic light of each road is controlled by determining the offset priority direction to be the direction which has heavier traffic at the time of controlling the offset parameter. Accordingly, the number of stops at red traffic lights of vehicles running in the priority direction can be reduced, the traffic capacity can be increased, the flow of vehicles on each road can be made smooth, and congestion can be reliably prevented and relieved.

According to the invention, congestion can be prevented and relieved and the traffic capacity of vehicles on each road can be maintained to be maximized, so that the time required for a vehicle to reach a destination can be minimized.

Many different embodiments of the present invention may be constructed without departing from the spirit and scope of the invention. It should be understood that the present invention is not limited to the specific embodiments described in this specification. To the contrary, the present invention is intended to cover various modifications and equivalent arrangements included within the spirit and scope of the claims.

What is claimed is:

1. A method of controlling traffic of vehicles running on each of a plurality of parallel running roads, each of said roads being connected at points positioned at an interval of predetermined distance, and at least one of said plurality of roads having a plurality of lanes, said method comprising the steps of:

detecting traffic of vehicles running in two counter directions on each of said roads, at a position before at least one connecting point of each of said plurality of roads; and changing a ratio of the number of lanes assigned to a particular direction of at least one of said plurality of roads, in accordance with said detected traffic of vehicles running in the two counter directions.

2. A method according to claim 1, wherein said step of changing the ratio of the number of lanes assigned to a particular direction includes a step of automatically changing the position of a center line for dividing the plurality of lines into two groups of lanes corresponding to the two counter directions.

3. A method according to claim 1, wherein said step of changing the ratio of the number of lanes assigned to a particular direction includes a step of displaying information of a lane change before a branch point of each road.

4. A method according to claim 3, wherein said step of controlling an offset of a plurality of traffic lights includes a step of controlling so as to make each of said roads have the same vehicle running priority direction.

5. A method according to claim 3, wherein said step of controlling an offset of a plurality of traffic lights includes a step of controlling so as to make said roads have opposite vehicle running priority directions.

6. A method according to claim 1, wherein said ratio includes the number of lanes assigned to a particular direction in comparison to the number of lanes assigned to a direction counter to the particular direction.

7. A method of controlling traffic of vehicles running on each of a plurality of parallel running roads, each of said roads being connected at points positioned at an interval of a predetermined distance, and at least one of said plurality of roads having a plurality of lanes, said method comprising the steps of:

detecting traffic of vehicles running in two counter directions on each of said plurality of roads; and changing a ratio of the number of lanes assigned to a particular direction of at least one of said plurality of roads, in accordance with said detected traffic of vehicles running in the two counter directions.

8. A method according to claim 7, wherein said step of changing the ratio of the number of lanes assigned to a particular direction includes a step of automatically changing the position of a center line for dividing the plurality of lines into two groups of lanes corresponding to the two counter directions.

9. A method according to claim 7, wherein said step of changing the ratio of the number of lanes assigned to a particular direction includes a step of displaying information of a lane change before a branch point of each road.

10. A method according to claim 9, wherein said step of controlling an offset of a plurality of traffic lights includes a step of controlling so as to make each of said roads have the same vehicle running priority direction.

11. A method according to claim 9, wherein said step of controlling an offset of a plurality of traffic lights includes a step of controlling so as to make said roads have opposite vehicle running priority directions.

12. A method according to claim 7, wherein said ratio includes the number of lanes assigned to a particular direction in comparison to the number of lanes assigned to a direction counter to the particular direction.

13. A method of controlling traffic of vehicles running on both of first and second parallel running roads, both of said first and second roads being connected at points positioned at an interval of a predetermined distance, and at least one of said first and second roads having a plurality of lanes, said method comprising the steps of:

detecting traffic of vehicles running in two counter directions on each of said first and second roads, at a position before a connecting point of each of said first and second roads; and changing a ratio of the number of lanes assigned to a particular direction of at least one of said first and second roads, in accordance with said detected traffic of vehicles running in the two counter directions.

14. A method according to claim 13, wherein said step of changing the ratio of the number of lanes assigned to a particular direction includes a step of automatically changing the position of a center line for dividing the plurality of lines into two groups of lanes corresponding to the two counter directions.

15. A method according to claim 13, wherein said step of changing the ratio of the number of lanes assigned to a particular direction includes a step of displaying information of a lane change before a branch point of each road.

16. A method according to claim 13, wherein said ratio includes the number of lanes assigned to a particular direction in comparison to the number of lanes assigned to a direction counter to the particular direction.

17. A method of controlling traffic of vehicles running on both of first and second parallel running roads, both of said first and second roads being connected at points positioned at an interval of a predetermined distance, and at least one of said first and second roads having a plurality of lanes, said method comprising the steps of:

detecting traffic of vehicles running in two counter directions on each of said first and second roads; and changing a ratio of the number of lanes assigned to a particular direction of at least one of said first and second roads, in accordance with said detected traffic of vehicles running in the two counter directions.

18. A method according to claim 17, wherein said step of changing the ratio of the number of lanes assigned to a particular direction includes a step of automatically changing the position of a center line for dividing the plurality of lines into two groups of lanes corresponding to the two counter directions.

19. A method according to claim 17, wherein said step of changing the ratio of the number of lanes assigned to a particular direction includes a step of displaying information of a lane change before a branch point of each road.

20. A method according to claim 17, wherein said ratio includes the number of lanes assigned to a particular direction in comparison to the number of lanes assigned to a direction counter to the particular direction.

21. A method of controlling traffic of vehicles running on each of plurality of parallel running roads, each of said roads being connected at a point positioned at an interval of a predetermined distance, and a plurality of intersections with traffic lights being installed on each of said roads at intervals of the predetermined distance, said method comprising the steps of:

detecting traffic of vehicles running in two counter directions on each of said roads, at a position before at least one connecting point of each of said plurality of roads; and controlling an offset parameter of a plurality of traffic lights on each of said roads, in accordance with said detected traffic of vehicles running in the two counter directions.

22. A method according to claim 21, wherein said step of controlling an offset of a plurality of traffic lights includes a step of controlling so as to make each of said roads have the same vehicle running priority direction.

23. A method according to claim 21, wherein said step of controlling an offset of a plurality of traffic lights includes a step of controlling so as to make said roads have opposite vehicle running priority directions.

24. A method of controlling traffic of vehicles running on each of a plurality of parallel running roads, each of said roads being connected at a point positioned at an interval of a predetermined distance, and a plurality of intersections with traffic lights being installed on each of said roads at intervals of the predetermined distance, said method comprising the steps of:

detecting traffic of vehicles running in two counter directions on each of said plurality of roads; and controlling an offset parameter of a plurality of traffic lights on each of said roads, in accordance with said detected traffic of vehicles running in the two counter directions.

25. A method according to claim 24, wherein said step of controlling an offset of a plurality of traffic lights includes a step of controlling so as to make each of said roads have the same vehicle running priority direction.

26. A method according to claim 24, wherein said step of controlling an offset of a plurality of traffic lights includes a step of controlling so as to make said roads have opposite vehicle running priority directions.

27. A method of controlling traffic of vehicles running on both of first and second parallel running roads, both of said first and second roads being connected at a point positioned at an interval of a predetermined distance, and a plurality of intersections with traffic lights being installed on each of said roads at intervals of the predetermined distance, said method comprising the steps of:

detecting traffic of vehicles running in two counter directions on both of said first and second roads, at a position before a connecting point of both of said first and second roads; and controlling an offset parameter of a plurality of traffic lights on both of said roads, in accordance with said detected traffic of vehicles running in the two counter directions.

28. A method of controlling traffic of vehicles running on both of first and second parallel running roads, both of said first and second roads being connected at a point positioned at an interval of a predetermined distance, and a plurality of intersections with traffic lights being installed on each of said roads at intervals of the predetermined distance, said method comprising the steps of:

detecting traffic of vehicles running in two counter directions on both of said first and second roads;

changing a ratio of the number of lanes assigned to a particular direction of at least one of said first and second roads, in accordance with said detected traffic of vehicles running in the two counter directions; and controlling an offset parameter of a plurality of traffic lights on both of said first and second roads, in accordance with said detected traffic of vehicles running in the two counter directions.

29. A method according to claim 28, wherein said ratio includes the number of lanes assigned to a particular direction in comparison to the number of lanes assigned to a direction counter to the particular direction.

30. A method of controlling traffic of vehicles running on each of a plurality of parallel running roads, each of said roads being connected at points positioned at an interval of a predetermined distance, a plurality of intersections with traffic lights being installed on each of said roads at intervals of the predetermined distance, and at least one of the plurality of roads having a plurality of lanes, said method comprising the steps of:

detecting traffic of vehicles running in two counter directions on each of said roads, at a position before at least one connecting point of each of said plurality of roads; and controlling an offset parameter of a plurality of traffic lights on each of said roads, in accordance with said detected traffic of vehicles running in the two counter directions.

31. A method of controlling traffic of vehicles running on each of a plurality of parallel running roads, each of said roads being connected at points positioned at an interval of a predetermined distance, a plurality of intersections with traffic lights being installed on each of said roads at intervals of the predetermined distance, and at least one of said plurality of roads having a plurality of lanes, said method comprising the steps of:

detecting traffic of vehicles running in two counter directions on each of said plurality of roads;

changing a ratio of the number of lanes assigned to a particular direction of at least one of said plurality of roads, in accordance with said detected traffic of vehicles running in the two counter directions; and controlling an offset parameter of a plurality of traffic lights on each of said roads, in accordance with said detected traffic of vehicles running in the two counter directions.

32. A method according to claim 31, wherein said ratio includes the number of lanes assigned to a particular direction in comparison to the number of lanes assigned to a direction counter to the particular direction.

33. A method of controlling traffic of vehicles running on both of first and second parallel running roads, both of said first and second roads being connected at points positioned at an interval of a predetermined distance, a plurality of intersections with traffic lights being installed on both of said first and second roads at intervals of the predetermined distance, and at least one of said first and second roads having a plurality of lanes, said method comprising the steps of:

detecting traffic of vehicles running in two counter directions on both of said first and second roads, at a position before a connecting point of said first and second roads;

changing a ratio of the number of lanes assigned to a particular direction of at least one of said first and second roads, in accordance with said detected traffic of vehicles running in the two counter directions; and controlling an offset parameter of a plurality of traffic lights on both of said first and second roads, in accordance with said detected traffic of vehicles running in the two counter directions.

34. A method according to claim 33, wherein said ratio includes the number of lanes assigned to a particular direction in comparison to the number of lanes assigned to a direction counter to the particular direction.

35. A method of controlling traffic of vehicles running on both of first and second parallel running roads, both of said first and second roads being connected at points positioned at an interval of a predetermined distance, and a plurality of intersections with traffic lights being installed on both roads at intervals of the predetermined distance, said method comprising the steps of:

detecting traffic of vehicles running in two counter directions on both of said first and second roads;

changing a ratio of the number of lanes assigned to a particular direction of at least one of said first and second roads, in accordance with said detected traffic of vehicles running in the two counter directions; and controlling an offset parameter of a plurality of traffic lights on both of said first and second roads, in accordance with said detected traffic of vehicles running in the two counter directions.

36. A method according to claim 35, wherein said ratio includes the number of lanes assigned to a particular direction in comparison to the number of lanes assigned to a direction counter to the particular direction.

* * * * *